US005382303A

United States Patent [19]

Anderson et al.

[11] Patent Number: 5,382,303

[45] Date of Patent: Jan. 17, 1995

[54] PERMANENT MAGNETS AND METHODS FOR THEIR FABRICATION

[75] Inventors: Richard L. Anderson, Marengo, Ill.; Fred G. Jones, Alma, Mich.

[73] Assignee: SPS Technologies, Inc., Newtown, Pa.

[21] Appl. No.: 868,030

[22] Filed: Apr. 13, 1992

[51] Int. Cl.[6] ..... H01F 1/053

[52] U.S. Cl. ..... 148/303; 420/582

[58] Field of Search ..... 148/303; 420/582

[56] References Cited

U.S. PATENT DOCUMENTS

| | | | |
|---|---|---|---|
| 3,431,889 | 1/1969 | Ostertag et al. | 75/170 |
| 3,546,030 | 12/1970 | Bushow et al. | 148/31.57 |
| 3,560,200 | 2/1971 | Nesbitt et al. | 75/122 |
| 3,695,945 | 10/1972 | Benz | 148/103 |
| 3,698,055 | 10/1972 | Holtz et al. | 29/180 |
| 3,701,695 | 10/1972 | Bushchow et al. | 148/103 |
| 3,839,101 | 10/1974 | Doser | 148/101 |
| 3,901,741 | 8/1975 | Benz et al. | 148/31.57 |
| 3,919,001 | 11/1975 | Ratnam | 148/31.57 |
| 3,919,002 | 11/1975 | Benz | 148/31.57 |
| 3,926,832 | 12/1975 | Barosi | 252/181.6 |
| 3,928,089 | 12/1975 | Cech | 148/105 |
| 3,947,295 | 3/1976 | Tawara et al. | 148/31.57 |
| 3,970,484 | 7/1976 | Doser | 148/103 |
| 3,977,917 | 8/1976 | Fujimura et al. | 148/31.57 |
| 3,982,971 | 9/1976 | Yamanaka et al. | 148/31.57 |
| 3,997,371 | 12/1976 | Tokunaga et al. | 148/31.57 |
| 4,002,508 | 1/1977 | Haberer | 148/31.57 |
| 4,047,982 | 9/1977 | Sagawa et al. | 148/101 |
| 4,075,042 | 2/1978 | Das | 148/103 |
| 4,075,437 | 2/1978 | Chin et al. | 179/114 R |
| 4,081,297 | 3/1978 | Nagel et al. | 148/103 |
| 4,131,495 | 12/1978 | Menth et al. | 148/31.57 |
| 4,135,953 | 1/1979 | Nagel et al. | 148/103 |
| 4,172,717 | 10/1979 | Tokunaga et al. | 75/152 |
| 4,192,696 | 3/1980 | Menth et al. | 148/101 |
| 4,210,471 | 7/1980 | Yoneyama et al. | 148/102 |
| 4,211,585 | 7/1980 | Inomata et al. | 148/31.57 |
| 4,213,802 | 7/1980 | Rothwarf et al. | 148/102 |
| 4,213,803 | 7/1980 | Yoneyama et al. | 148/102 |
| 4,221,613 | 9/1980 | Imaizumi et al. | 148/103 |
| 4,276,097 | 6/1981 | Bergner et al. | 148/101 |
| 4,284,440 | 8/1981 | Tokunaga et al. | 148/31.57 |
| 4,289,549 | 9/1981 | Kasai | 148/101 |
| 4,322,257 | 3/1982 | Menth et al. | 148/101 |
| 4,369,075 | 1/1983 | Nobuo et al. | 148/102 |
| 4,375,996 | 3/1983 | Tawara | 148/31.57 |
| 4,382,061 | 5/1983 | Herget | 420/435 |
| 4,497,672 | 2/1985 | Tawara | 148/102 |
| 4,536,233 | 8/1985 | Okonogi | 148/101 |
| 4,565,587 | 1/1986 | Narasimhan | 148/31.57 |
| 4,578,125 | 3/1986 | Sahashi et al. | 148/31.57 |
| 4,746,378 | 5/1988 | Wysiekierski et al. | 148/101 |

OTHER PUBLICATIONS

Optimum Manufacturing Conditions For 2-17 SmCo Magnets, M. Edeling and C. Herget, Paper No. 18P9227 at the 10th International Workshop on Rare—Earth Magents And Their Applications, May 16-19, 1989 Kyoto, Japan.

*Primary Examiner*—George Wyszomierski

*Attorney, Agent, or Firm*—Woodcock Washburn Kurtz Mackiewicz & Norris

[57] ABSTRACT

Novel permanent magnets of $Sm_2Co_{17}$ type crystal structure are provided herein. The magnets preferably have samarium, cobalt, iron, copper and zirconium in specified amounts. They have superior magnetic properties, including maximum energy product, intrinsic coercivity and second quadrant loop squareness. The compositions of the magnets can be expressed by a general formula $[Co_a\ Fe_b\ Cu_c\ Zr_d]_e$ Sm. Preferred embodiments, wherein a is about 0.6 to about 0.7, b is about 0.2 to about 0.3, c is about 0.06 to about 0.07, d is about 0.02 to about 0.03, and e is about 7.2 to about 7.4, have unexpectedly high maximum energy product, high intrinsic coercive force and squareness. Processes for producing the improved alloy are also provided.

23 Claims, 6 Drawing Sheets

PERMANENT MAGNETS AND METHODS FOR THEIR FABRICATION

FIELD OF THE INVENTION

This invention is directed to improved permanent magnets, and more particularly to improvements in permanent magnets having a crystal structure characteristic of $Sm_2Co_{17}$. This invention is also directed to processes for producing such magnets.

BACKGROUND OF THE INVENTION

Permanent magnets are developed for several important magnetic characteristics including high maximum energy content, high resistance to demagnetization, and high induction. Maximum energy content is important because permanent magnets are used primarily to produce a magnetic flux field which is a form of potential energy. The maximum energy content that is available for use outside the magnet body, commonly referred to as maximum energy product, $BH_{max}$, is a well known indicator of the quality of a magnet. The higher the maximum energy product, the more energy available for use outside the magnet and thus, the better the magnet.

One measure of the resistance of the magnet to demagnetization is known as intrinsic coercivity, commonly referred to as "$H_{ci}$". In addition to having a high $BH_{max}$, it is also important for a permanent magnet to have high resistance to demagnetization and thus, a high $H_{ci}$. Magnets which have intrinsic coercivities above about 26 KOe range. although desirable, may not be practical, since it is difficult to magnetize them.

The advantages of samarium cobalt alloy magnets are now well-known. For example, such magnets are especially suitable for use in small electric motors and small appliances. However, one disadvantage to the use of magnets comprised of $Sm_2Co_{17}$ alloys is that, while they provide adequate maximum energy products, they have intrinsic coercive forces which are too low for many applications. For example, in U.S. Pat. Nos. 4,210,471, issued Jul. 1, 1980, in the name of Yoneyama et al.; 4,213,803, issued Jul. 22, 1980, in the name of Yoneyama et al.; 4,284,440, issued Aug. 18, 1981, in the name of Tokunaga et al.; and 4,289,549, issued Sep. 15, 1981, in the name of Kasai, magnets are provided which have $BH_{max}$ values about 30 MGOe, however, the $H_{ci}$ values of these magnets are only about 6 to 8 KOe. Such magnets are not suitable for use in applications that require large electric DC motors, such as robots and major appliances.

Various attempts have been made previously to provide samarium cobalt permanent magnets having high intrinsic coercivities. While such improvements have resulted in the production of magnets with higher coercivity, this improvement has been offset by loss of other desirable properties, including maximum energy product, second quadrant loop squareness, and remanence. For example, U.S. Pat. No. 4,536,233, issued Aug. 20, 1985 in the name of Okonogi et al. discloses samarium cobalt permanent magnets having an $H_{ci}$ of about 15 KOe. However, the magnets were disclosed to have a $BH_{max}$ of only about 16 MGOe. This is significantly less than the $BH_{max}$ of about 30 MGOe as disclosed by others. Similarly, U.S. Pat. No. 4,565,587, issued Jan. 21, 1986 in the name of Narasimhan discloses a $Sm_2Co_{17}$ permanent magnet having a maximum energy product of about 24 MGOe with an intrinsic coercivity of about 18 KOe. U.S. Pat. No. 4,497,672, issued Feb. 5, 1985 in the name of Tawara et al., discloses a method for producing samarium cobalt permanent magnets having maximum energy products of about 22 MGOe and intrinsic coercivities of about 23.4 KOe. Thus, improved intrinsic coercivity in a permanent magnet has only been obtainable heretofore at the expense of a decrease in maximum energy product.

In addition to maximum energy product and intrinsic coercivity, there is another important figure of merit for determining the quality of permanent magnets. This parameter, known as second quadrant loop squareness ("$H_k$"), is a measure of how square the demagnetization curve is. By definition, it is the H value (H is the demagnetizing force) measured at a magnetization 10 percent down from the residual induction $B_r$. In practical terms, $H_k$ is indicative of how much energy can be stored in the field. High $H_k$ and $H_{ci}$ values are desirable because they reflect an increase in the stability of the magnet. In addition, these properties are important since they affect the required geometry of the magnet. Thus, they are determinative, in part, of whether a magnet will perform well in certain applications.

Various attempts to produce samarium cobalt magnets that have, at once, high maximum energy products, high intrinsic coercivities and high second quadrant loop squareness, have not been successful. For example, in U.S. Pat. No. 4,746,378, issued May 24, 1988 in the name of Wysiekierski et al., there is disclosed a process for producing an alloy which can form magnets having maximum energy products of 30 MGOe. However, the intrinsic coercivities are only about 14–16 KOe, and the second quadrant loop squareness is only about 9.0 KOe for these magnets.

In Paper No. 18PO227 of the 10th International Workshop on Rare-Earth Magnets and Their Applications, Kyoto, Japan, May 16–18, 1989, Edeling and Herget described a process for producing magnets having improved intrinsic coercivities and improved squareness. However, these magnets are disclosed to have been made from calciothermic, co-reduced alloys that contain non-magnetizable oxide and carbide impurities. The presence of these impurities in the alloy starting materials results in a decrease in the flux related properties $BH_{max}$ and $B_r$ and thus, the quality of the magnets produced. Edeling and Herget indicate that the results they obtained could not be duplicated using magnets prepared from melted 2–17 alloys.

Despite many efforts directed to producing improved magnets made from $Sm_2Co_{17}$ alloys, the magnets produced by prior processes do not possess, at once, good flux properties, including high maximum energy products, as well as high intrinsic coercivities and high second quadrant loop squareness. Accordingly, there is a need for permanent magnets which exhibit unique combinations of these desirable magnetic properties.

OBJECTS OF THE INVENTION

It is an object of the present invention to provide permanent magnets which have, at once, improved maximum energy products, improved intrinsic coercive forces and improved second quadrant loop squareness.

Yet another object of the invention is to provide improved permanent magnets of samarium-cobalt with the addition of copper, iron and zirconium.

A further object is to provide improved processes for preparing high performance samarium-cobalt permanent magnets having improved magnetic properties.

These and other objects of the present invention will become apparent to persons of ordinary skill in the art from a review of the instant specification and appended claims.

SUMMARY OF THE INVENTION

Figure 1:
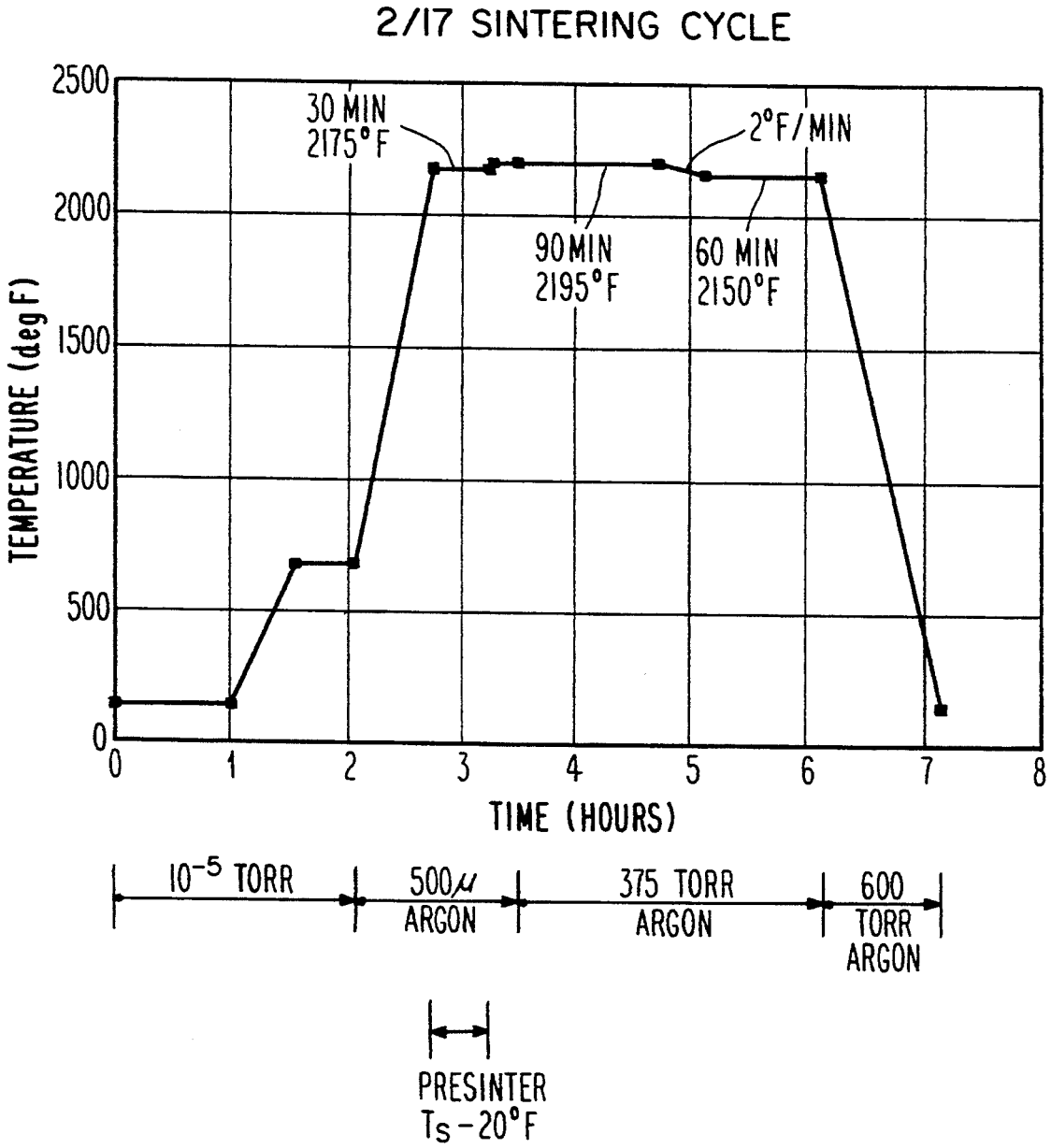
FIG. 1 depicts a preferred sintering cycle for producing improved permanent magnets in accordance with the invention.

The present invention provides improved permanent magnets having a crystal structure characteristic of $Sm_2Co_{17}$, and consisting essentially of samarium, cobalt, iron, copper and zirconium, in which the relative amounts of Sm, Co, Fe, Cu and Zr are optimized within narrow ranges.

In accordance with the preferred embodiments, the present invention provides permanent magnets consisting essentially of samarium in an amount of from about 25.0 to about 26.3%, cobalt from about 47.9 to about 49.6%, iron from about 17.0 to about 17.7%, copper from about 4.9 to about 5.2%, and zirconium from about 2.7 to about 3.3%, by weight. They have a superior combination of magnetic properties, possessing, at once, improved maximum energy products, improved intrinsic coercivities and improved second quadrant loop squareness of at least about 12 KOe. Magnets in accordance with the invention also have excellent flux properties, since they may have residual induction (hereinafter referred to as remanence or "$B_r$") of at least about 10 KG. Residual induction (or remanence) is the value of magnetic induction in gauss, when the magnetizing force has been reduced to zero.

In another aspect, the invention is a permanent magnet comprising at least one alloy having the formula $[Co_aFe_b\ CU_c\ Zr_d]_e$ Sm wherein a is from about 0.64 to about 0.68; b is about 0.23 to about 0.27; c is about 0.060 to about 0.068; d is about 0.024 to about 0.029; and e is from 7.1 to about 7.7, wherein the magnet has an $H_k$ of at least about 12 KOe.

The magnets are prepared by an improved process comprising the steps of providing a powder compact prepared from at least one melted samarium cobalt metal alloy, and sintering the compact. In a preferred aspect of the process of the invention, the sintering comprises selecting a sintering temperature of from about 2050 to 2300 degrees Fahrenheit, presintering the powdered compact at a temperature of from about 5 to about 50 degrees Fahrenheit less than said preselected sintering temperature for about 10 to about 90 minutes, then sintering said compact at said sintering temperature for from about 30 to about 270 minutes, and then homogenizing said compact at a temperature lower than the sintering temperature, and between about 2000 and about 2295 degrees Fahrenheit, for about 20 to about 180 minutes.

The present invention is further based partly on the discovery that the magnetic properties of $Sm_2Co_{17}$ magnets can be improved by means of processes in which sintering is followed by solution thermal treatment, which is in turn followed by aging thermal treatment step, with the compacted alloy being heated and cooled in each step in a controlled manner, preferably under vacuum or an inert gas atmosphere. It has been found that such controlled heating and cooling of the compacted alloy from the sintering step through the aging step enables improved magnetic properties to be obtained in a permanent magnet made from such an alloy. For example, it is possible for the alloy to have a relatively high iron content (from about 17.0 to about 17.7% by weight), to provide high remanent induction, without the 2–17 Sm—Co phase being rendered unstable, and to have a relatively high samarium content (from about 25.0 to about 26.3% by weight) to provide good second quadrant loop squareness.

The processes of the invention are designed to use compacted powders prepared from at least one melted alloy (as opposed to calciothermic co-reduced alloys) to produce magnets having superior properties. In addition, the process of the invention minimizes loss of raw materials and products, thereby reducing cost.

Practice of the processes of the present invention, which preferably combine presintering, sintering, solution thermal treatment and aging thermal treatment, confers the distinct advantage of products exhibiting exceptionally high magnetic quality. Indeed, in accordance with a preferred embodiment, the magnets of the invention have maximum energy products of at least about 24 MGOe, intrinsic coercivities of at least about 20 KOe, and squareness of about 12 KOe. Moreover, magnets having maximum energy products of at least about 26 MGOe and even 30 MGOe are readily produced. Such values, especially the squareness properties, are much higher than those previously attained with any other known $Sm_2CO_{17}$ magnets.

DETAILED DESCRIPTION OF THE INVENTION

The permanent magnets of this invention comprise at least one alloy comprising cobalt, iron, copper, zirconium and samarium. The compositions of the magnets are expressed by the formula:

$$[CO_aFe_bCu_cZr_d]_eSm \qquad \text{EQ. 1}$$

wherein a is about 0.64 to about 0.68, b is about 0.23 to about 0.27, c is about 0.060 to about 0.068, d is about 0.024 to about 0.029, and e is about 7.1 to about 7.7. In certain preferred embodiments, a is about 0.64 to about 0.68, b is about 0.23 to about 0.27, c is about 0.060 to about 0.068, d is about 0.024 to 0.029, and e is about 7.2–7.4. In more preferred embodiments, a is about 0.66, b is about 0.25, c is about 0.064, d is about 0.027 and e is about 7.3.

Preferably, the magnets of the invention have from about 25.5 to about 26.0% by weight samarium, from about 48.2 to about 49.2% by weight cobalt, from about 17.1 to about 17.5% by weight iron, from about 4.9 to about 5.2% by weight copper, and from about 2.9 to about 3.3% by weight zirconium. In more preferred embodiments, the magnets have nominal compositions consisting essentially of samarium in an amount of about 25.8%, cobalt at about 48.7%, iron at about 17.3%, copper at about 5.1%, and zirconium at about 3.1%. Percentages indicate weight percentages, based upon the weight of the magnet. The magnets, and the alloys from which they are produced, will contain impurities as a result of industrial production.

It is preferred that the magnets of the invention comprise two alloys, hereinafter referred to as "base alloy" and "adder alloy", which are blended together to achieve an optimum level of "e" in the molecular formula such that the magnetic properties of interest, $H_k$, $H_{ci}$ and $BH_{max}$ are optimized for the application intended. The composition of the base alloy is preferably close to the composition of the eventual magnetized alloy, whereas the composition of the adder alloy is slightly higher in samarium. The base and adder alloys each have the formula $[Co_aFe_bCu_cZr_d]_e$ Sm wherein a is from about 0.6 to about 0.7, b is from about 0.2 to about 0.3, c is from about 0.06 to 0.07, and d is from about 0.02 to about 0.03. The base and adder alloys differ substantially only in the value of "e", the composition of the adder alloy being slightly higher in samarium. For the base alloy, e is about 7.7 to 8.5, preferably about 7.9 to 8.3; for the adder alloy, e is about 5.1 to 5.9, preferably 5.3 to about 5.7. Even more preferably, e is about 8.1 and about 5.5 for the base and adder alloys, respectively.

The addition of the adder alloy creates, in a known way, particularly favorable sintering conditions. It provides a mechanism to precisely control the samarium content of the final magnet alloy and to compensate for loss of samarium due to oxidation during the production process. Accordingly, the ratio of base to adder will vary from batch to batch depending upon raw material chemistry and the degree of oxidation of samarium.

Table 1 indicates the nominal "e" values in the molecular formula for preferred alloys of the raw materials and nominal "e" values for the sintered magnets.

TABLE 1

NOMINAL "e" VALUES FOR RAW MATERIALS & SINTERED MAGNETS

| BASE ALLOY | ADDER ALLOY | SINTERED PRODUCT |
|---|---|---|
| 8.1 | 5.5 | 7.1 to 7.7 |

The base alloy typically has an overall composition comprising about 48.0 to 53.0 weight percent cobalt, about 16.0 to 19.0 weight percent iron, about 4.0 to 6.0 weight percent copper, about 2.0 to 4.0 weight percent zirconium, and about 22.0 to 25.0 weight percent samarium. A preferred composition of the base alloy, in weight percent, is as follows:

| | Nominal | Minimum | Maximum |
|---|---|---|---|
| Cobalt | 49.9% | 49.2% | 50.6% |
| Iron | 17.8 | 17.6 | 18.0 |
| Copper | 5.2 | 5.1 | 5.3 |
| Zirconium | 3.2 | 3.1 | 3.3 |
| Samarium | 23.9 | 23.6 | 24.2 |

The adder alloy typically has an overall composition comprising about 43.0 to 47.0 weight percent cobalt, about 15.0 to 17.0 weight percent iron, about 4.0 to 5.0 weight percent copper, about 2.0 to 4.0 weight percent zirconium, and about 29.0 to 33.0 weight percent samarium. A preferred composition of the adder alloy, in weight percent, is as follows:

| | Nominal | Minimum | Maximum |
|---|---|---|---|
| Cobalt | 45.0% | 44.1% | 45.9% |
| Iron | 16.0 | 15.8 | 16.2 |
| Copper | 4.7 | 4.6 | 4.8 |
| Zirconium | 2.9 | 2.8 | 3.0 |
| Samarium | 31.4 | 30.9 | 31.9 |

If two alloys are used in carrying out the processes of the invention, the alloys are treated separately during fine powder preparation until the blending step.

The permanent magnet alloys of the invention may be manufactured by processes which comprise the steps of providing a powder compact prepared from at least one melted samarium cobalt metal alloy, compacting the powder in a magnetic field, sintering the compact, subjecting the sintered compact to a solution thermal treatment, and then to an aging thermal treatment.

In one embodiment of the invention, a powder compact is provided which has been prepared from at least one, preferably two, melted samarium cobalt metal alloys. Advantageously, the materials of the powder compact are pre-alloyed. The mixture (or mixtures) of raw materials are melted (for instance, vacuum melted) under argon partial pressure using a high-frequency induction furnace or like equipment. The melts are then either comminuted and formed into powder particles, cast into crystalline ingots, or chill-cast into crystalline ingot fragments. The crystalline ingots or chill-cast fragments can be jaw-crushed under an inert atmosphere, which is typically argon.

The crushed alloys can then be further separately milled to coarse powder under an inert atmosphere and screened to a particle size no greater than 600 microns in maximum dimension. During the impact milling procedure, liquid nitrogen is typically fed to the milling chamber in order to remove the heat of milling and maintain the brittleness of the alloy, to facilitate more efficient size reduction, and to minimize the introduction of deformation-induced defects. Preferably, the particle size after screening is no greater than 600 microns in maximum dimension, more preferably no greater than 300 microns.

Each of the milled and screened alloys is then transferred to a water-cooled attritor mill (or stirred ball mill) charged, with a suitable hydrocarbon liquid which serves to remove the heat generated during milling and to prevent oxidation of the material during fine powder preparation. Suitable hydrocarbon liquids are those with boiling points sufficiently low to facilitate later evaporation of the liquid or those which do not adversely react with the rare earth component of the alloy. These liquids include, for example, acetone, hexane, heptane, toluene, and the like, with hexane being preferred. The particles are attrited for a period of time sufficient to reduce particle size to no greater than 40 microns in maximum dimension, preferably no greater than 30 microns, more preferably no greater than 20 microns. Typically, the particles are reduced to a particle size having an average maximum diameter of about 2.5 to about 5.0μ (microns), preferably about 3.8 to about 4.6μ, with 4.4μ being more preferred, as measured by a suitable measuring device, for example, a Fisher sub-sieve size analyzer.

The hydrocarbon/alloy slurry can then be discharged to settling tanks where the slurry is allowed to stand for a period of time sufficient for the alloy to separate from the hydrocarbon and settle, usually a period of several minutes. The hydrocarbon is decanted from the slurry, and the hexane/alloy slurry is transferred to evaporator chambers for drying.

The evaporator chamber is advantageously fitted with a water jacket. Before evaporation is initiated, the chamber is purged with argon for at least about 30 minutes, preferably for about 60 minutes. Then hot water at a temperature of about 150 to 200 degrees Fahrenheit, preferably about 185 degrees Fahrenheit, is passed through the double wall of the evaporator chamber, in order to initiate evaporation of the hydrocarbon. The hydrocarbon is advantageously remotely condensed for reuse in the process. The chamber is heated until the evaporation of the hydrocarbon ceases at which point the chamber is again purged with argon to reduce residual vapors. Preferably, argon purging is continued for about 45–90 minutes, more preferably for about 60 minutes. The pressure in the chamber is then reduced to below 3000$\mu$, preferably to below 100$\mu$, for at least 60 minutes, preferably for about 120 to 300 minutes. Then, the chamber is back-filled with an inert gas, preferably argon, to nearly atmospheric pressure. Heating is discontinued and the chamber is cooled. When the temperature drops to about 140 degrees Fahrenheit, the pressure in the chamber is further reduced to about 1000$\mu$ to 2$\mu$ in order to remove final traces of hydrocarbon and any moisture.

In order to passivate the powder, the chamber is heated and maintained at a temperature of from about 90 to about 130 degrees Fahrenheit, preferably about 120 degrees Fahrenheit, and the chamber is backfilled with oxygen or an oxygen-containing gas so that the pressure in the chamber is at least atmospheric pressure, preferably atmospheric pressure plus 2 psig. Usually it is disadvantageous for the temperature in the chamber to drop below about 90 degrees Fahrenheit. Preferably, an oxygen-containing gas is used for passivation such as a mixture of inert gas and air. An inert gas is any which does not react with the alloy powder being passivated including helium and argon, with argon being preferred. After an initial holding period of several minutes, a slow purge of an air-inert gas mixture is established to apply a passivating oxide surface to the powder. The purpose of the initial holding period is to establish a positive pressure condition in the powder chamber to insure that the powder is exposed only to the passivating gas mixture as the chamber is set up for continuous purging. This passivating treatment makes it possible to handle the powder in air during subsequent compaction without spontaneous combustion. In a preferred embodiment, a mixture of argon and air is used, comprising about 75 to 98 volume percent argon and 2 to 25 volume percent air, preferably about 80 to 98 volume percent argon and 2 to 20 volume percent air, more preferably about 85 to 98 volume percent argon and 2 to 15 volume percent air. The alloy powder is exposed to the oxygen or oxygen-containing gas for a period of time sufficient to passivate the powder, usually for a period of time ranging from about 0.1 to about 300 hours, preferably from about 0.5 to 50 hours, more preferably for from about 15–17 hours. The total cycle time for the drying and passivation operation is about 30–60 hours, preferably about 45–50 hours.

The dried and passivated powder is then subjected to powder blending wherein the samarium cobalt powder is homogenized and mixed to provide the powder required for compacting. If more than one alloy is utilized, the alloy powders are blended in a critical ratio (described above) sufficient to provide a magnet having the formula set forth in Equation 1. A twin-shell dry blender can be used for this operation. Preferably, powder blending is conducted entirely in an argon atmosphere in order to prevent further oxidation of the powder.

The blended samarium cobalt alloy powder is then placed in a die of desired shape and oriented in a magnetic field of greater than about 6 KOe, preferably greater than about 10 KOe, more preferably greater than about 12 KOe. The powders are then compacted in the die typically at pressures of 1.5 to 4.2 metric tons per square centimeter. The direction of the orienting magnetic field and the direction of compaction can be parallel or perpendicular. Magnets with higher maximum energy products typically are obtained when the directions are perpendicular. Compaction can be done using any compacting means known to those of ordinary skill in the art, for example, isostatic compaction or die pressing. Preferably, a hydraulic compacting press and die is used. Compaction may be undertaken in the presence of air.

The resulting "green compacts" are then sintered such as in a cold-wall vacuum furnace under an inert gas atmosphere, for example, under argon, or an argon/helium mixture. In a preferred embodiment, the green compact is presintered at an elevated temperature in an inert gas partial pressure atmosphere prior to sintering.

In practicing a preferred method of the invention, a sintering temperature of from about 2050 to about 2300 degrees Fahrenheit is selected. The green compact is then presintered at a temperature of from about 5 to about 50 degrees Fahrenheit less than the preselected sintering temperature for from about 10 to about 90 minutes, preferably at a temperature of from about 10 to 30 degrees Fahrenheit less than the sintering temperature for from about 20 to about 60 minutes, more preferably at a temperature about 20 degrees Fahrenheit less than the sintering temperature for about 30 minutes.

In a preferred embodiment of the invention, a vacuum partial pressure of about $10^0$ to $10^{-7}$ Torr, preferably about $10^{-1}$ to $10^{-6}$ Torr, more preferably about $10^{-5}$ Torr, is applied prior to sintering, preferably for about 30 to 180 minutes, more preferably for about 60 to 150 minutes, even more preferably for about 120 minutes. During that time period, the temperature is slowly increased. Then, an inert gas, preferably argon, is introduced into the system at a pressure of about 100 to 3000$\mu$, preferably at about 300 to 1000$\mu$, more preferably at about 500 $\mu$, and the temperature is increased again to about 1550 degrees Fahrenheit, whereupon the argon partial pressure is further increased to 375 Torr, and the temperature is again increased preferably up to about 2030 to about 2280 degrees Fahrenheit for presintering.

Sintering then occurs. Preferably, the compact is sintered at a temperature of about 2050 to 2300 degrees Fahrenheit for about 30 to 270 minutes, more preferably at 2125 to 2250 degrees Fahrenheit for about 60 to 180 minutes, even more preferably in accordance with FIG. 1. The compact is then homogenized at a temperature of about 1900 to 2250 degrees Fahrenheit for from about 20 to 180 minutes, preferably at about 2050 to about 2200 degrees Fahrenheit for about 40 to 120 minutes, more preferably in accordance with FIG. 1. In going from the sintering stage to the homogenizing stage, the compact is continuously cooled from the sintering temperature to the homogenizing temperature at a rate of about 1 to 5 degrees Fahrenheit per minute, preferably at a rate of about 1 to 3 degrees Fahrenheit per minute, more preferably at a rate of 2 degrees Fahrenheit per minute. Both sintering and homogenization are carried out under an inert atmosphere, preferably under argon, at a partial pressure of at least about 0.5 to about 760 Torr, preferably at about 5 to 650 Torr, more preferably at about 375 Torr. After the homogenization stage is completed, the compact is cooled to about room temperature.

In order to achieve magnets having the superior properties described herein, it is particularly important to control the temperatures and pressures during each of the process steps, and especially during sintering, in the manner described herein to avoid unwanted oxidation or excessive samarium vaporization. One such preferred sintering cycle is depicted in FIG. 1.

Figure 2:
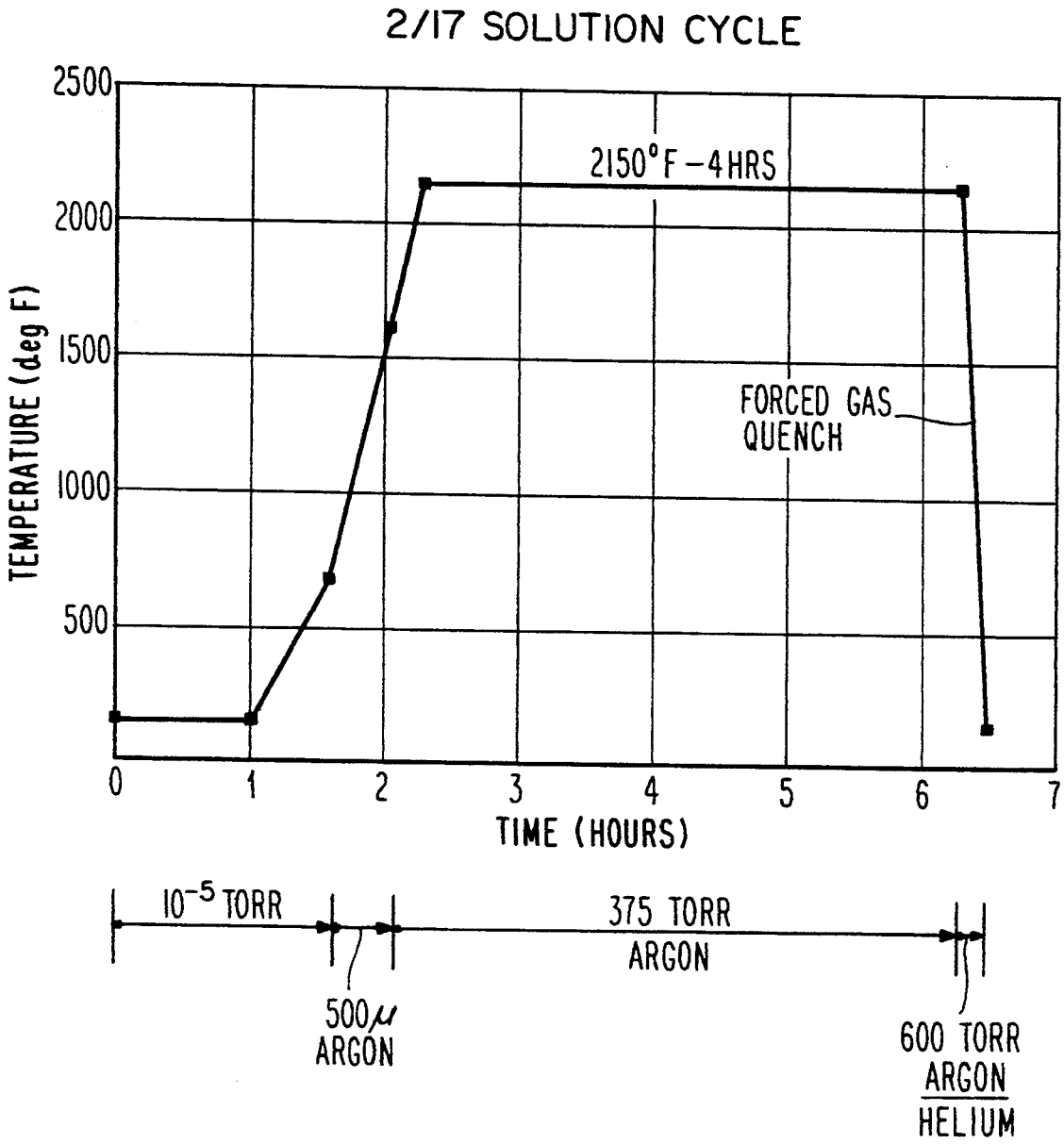
FIG. 2 shows a preferred solution thermal treatment cycle for producing improved permanent magnets of the invention.

The resulting sintered magnets are then subjected to a solution thermal treatment to further homogenize the sintered product, prevent it from going through an undesirable phase separation, and to provide the basic structure necessary to increase the intrinsic coercivity during the final aging treatment. In a preferred embodiment, a vacuum partial pressure of at least about $10^0$ to $10^{-7}$ Torr, preferably at least about $10^{-5}$ Torr is initially applied, preferably for about 30 to 180 minutes, more preferably for about 90 minutes, during which time the temperature of the solid body is slowly increased from room temperature to about 500 to 900 degrees Fahrenheit. After this period of time has passed, an inert gas, preferably argon, is introduced into the system, at a pressure of about 100 to about 3000$\mu$, preferably at about 300 to 1000$\mu$, more preferably at about 500$\mu$. As the pressure increases, the temperature is again increased to about 1550 degrees Fahrenheit, whereupon the argon partial pressure is further increased to about 375 Torr, then the temperature is increased, preferably up to about 2000 to 2300 degrees Fahrenheit, more preferably up to about 2100 to about 2200 degrees Fahrenheit, even more preferably up to about 2150 degrees Fahrenheit. The sintered body is then held at this temperature for from about 120 to 480 minutes, preferably about 180 to 360 minutes, preferably under an inert gas atmosphere, more preferably under about 325 to 425 Torr of argon, even more preferably under about 375 Torr of argon. The samples are then subjected to a forced gas quench in an inert atmosphere, preferably in argon/helium, with a pressure of at least about 500 Torr to about 2 atmospheres positive pressure, more preferably at about 600 Torr to about 1 atmosphere positive pressure, even more preferably at about 600 Torr. It is also preferred that this gas quenching step be carried out rapidly, and indeed as rapidly as possible, without cracking the sample. A preferred solution heat treatment cycle is depicted in FIG. 2.

Figure 3:
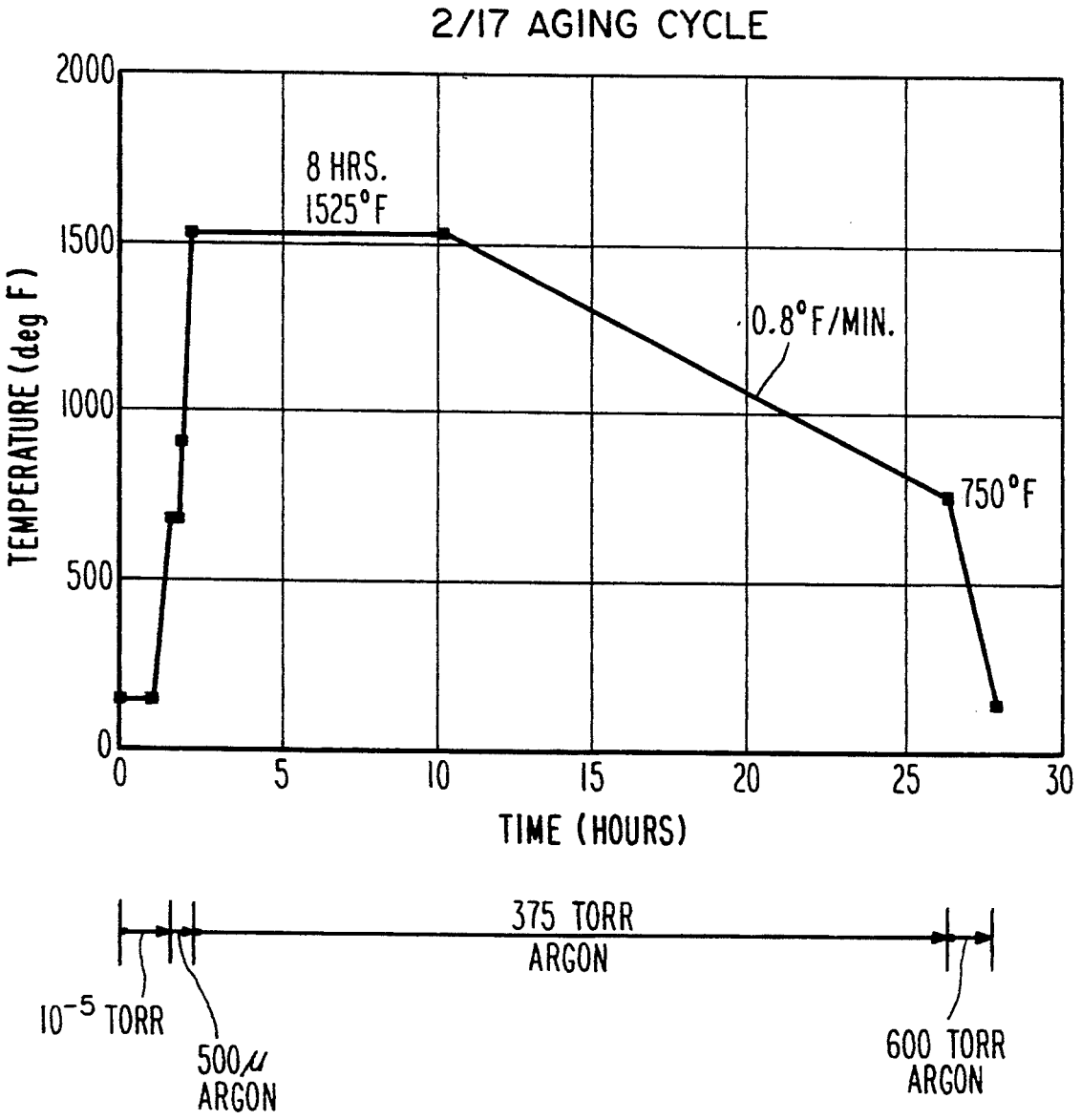
FIG. 3 depicts one preferred aging thermal treatment cycle for use in fabricating the improved permanent magnets in accordance with the invention.

The sintered and solution-heat-treated solid body is then subjected to another thermal treatment step referred to as an aging cycle. The aging cycle helps to establish the proper phase distribution and morphology in the magnet, to develop the appropriate magnetic properties and to produce a high quality magnet. During the aging cycle, the temperature and vacuum partial pressure is increased, and the sintered compact is held at an elevated temperature for several hours and then cooled in a controlled manner. In a preferred embodiment, a vacuum partial pressure of about $10^{-5}$ Torr is initially applied for about 30 to 180 minutes, preferably for about 60 to 120 minutes. An inert gas is then introduced into the system, and the pressure is increased to about 100 to 3000$\mu$, preferably to about 300 to 1000$\mu$, more preferably to about 500$\mu$, and the temperature of the solid body is slowly increased from room temperature to about 500 to 900 degrees Fahrenheit. After about 15 to 300 minutes, the pressure of the inert gas is again increased, preferably to from about 200 to about 600 Torr, more preferably to from about 300 to 400 Torr. The solid body is then heated to a temperature of from about 1425 to 1625 degrees Fahrenheit for about 360 to 600 minutes, preferably from about 1475 to 1575 degrees Fahrenheit for about 420 to 540 minutes. Preferably the heating occurs in an inert gas, such as argon, at from about 200 to about 600 Torr, preferably at about 375 Torr. The solid body is then cooled to about 600 to 900 degrees Fahrenheit, preferably to about 700 to 800 degrees Fahrenheit, at a rate of about 0.5 to 2 degrees Fahrenheit per minute, preferably about 1 degree Fahrenheit per minute, even more preferably about 0.8 degrees Fahrenheit per minute. The solid body subsequently is cooled to room temperature. The aging cycle takes approximately 25 to 30 hours to complete. A preferred aging cycle is depicted in FIG. 3.

Typical processing steps together with parameter ranges are set forth herein. However, procedures carried out in the order set forth above, and with the temperatures, pressures, and cooling and heating rates set forth herein and in FIGS. 1–3 are preferred aspects of the method of the invention.

Certain optional steps otherwise known to those skilled in the art are permitted. For example, sintered magnets can be subjected to wet grinding and/or can be cleaned in an ultrasonic vapor degreaser.

Magnets that are manufactured in accordance with the methods of the invention have, at the same time, excellent intrinsic coercivities, excellent second quadrant loop squareness and excellent maximum energy products. For example, by practicing the methods of the invention, magnets having the following properties have been achieved:

| | Isopressed | Axial |
|---|---|---|
| $B_r$ = | 11.0 KG | 10.4 KG |
| $H_c$ = | 10.3 KOe | 9.7 KOe |
| $H_{ci}$ = | 25.2 KOe | 28.4 KOe |
| $H_k$ = | 13.7 KOe | 12.1 KOe |
| $BH_{max}$ = | 28.5 MGOe | 25.5 MGOe |

The measurements were taken using a commercially available hysteresigraph (for example, a Walker Scientific Model No. AMH-1050-50). Prior to taking the measurements, the samples were pulse magnetized with at least 50 KOe in order to achieve a technically saturated measurement. In addition, the open circuit load line of the sample to be measured exceeded a value of 1.

Figure 4A:
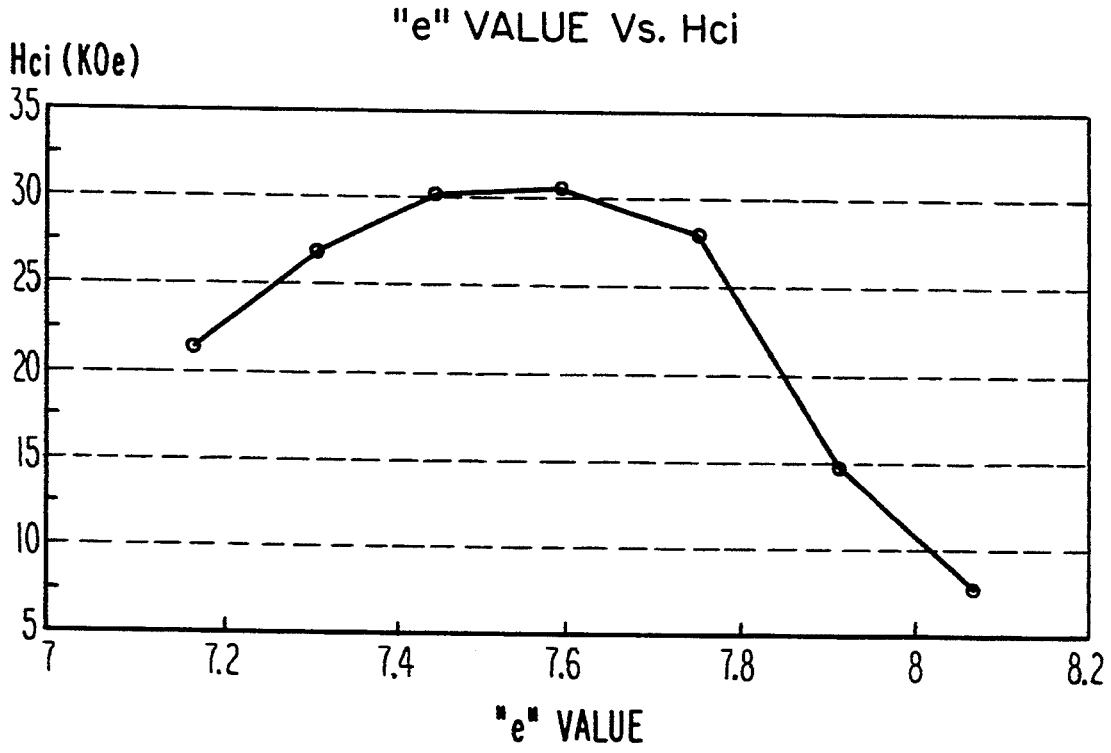
FIGS. 4A through 4C demonstrate the strong influence the composition of the magnet has on various magnetic properties, including intrinsic coercive force, second quadrant loop squareness and maximum energy product.
Figure 4B:
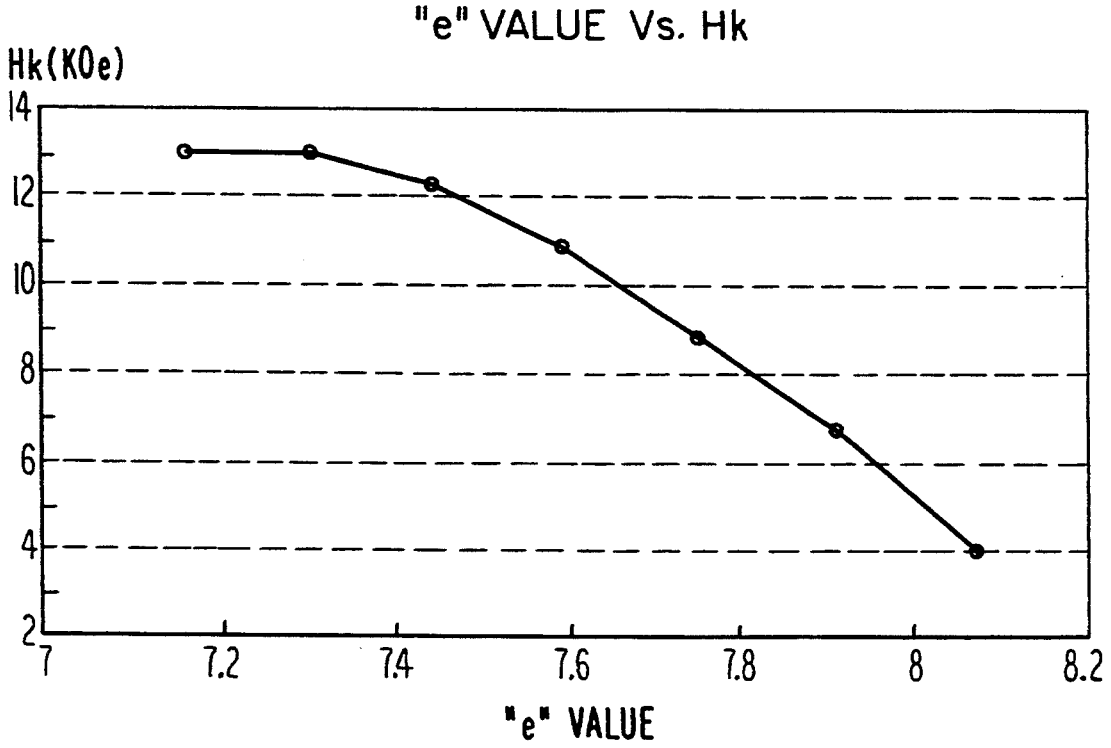
Figure 4C:
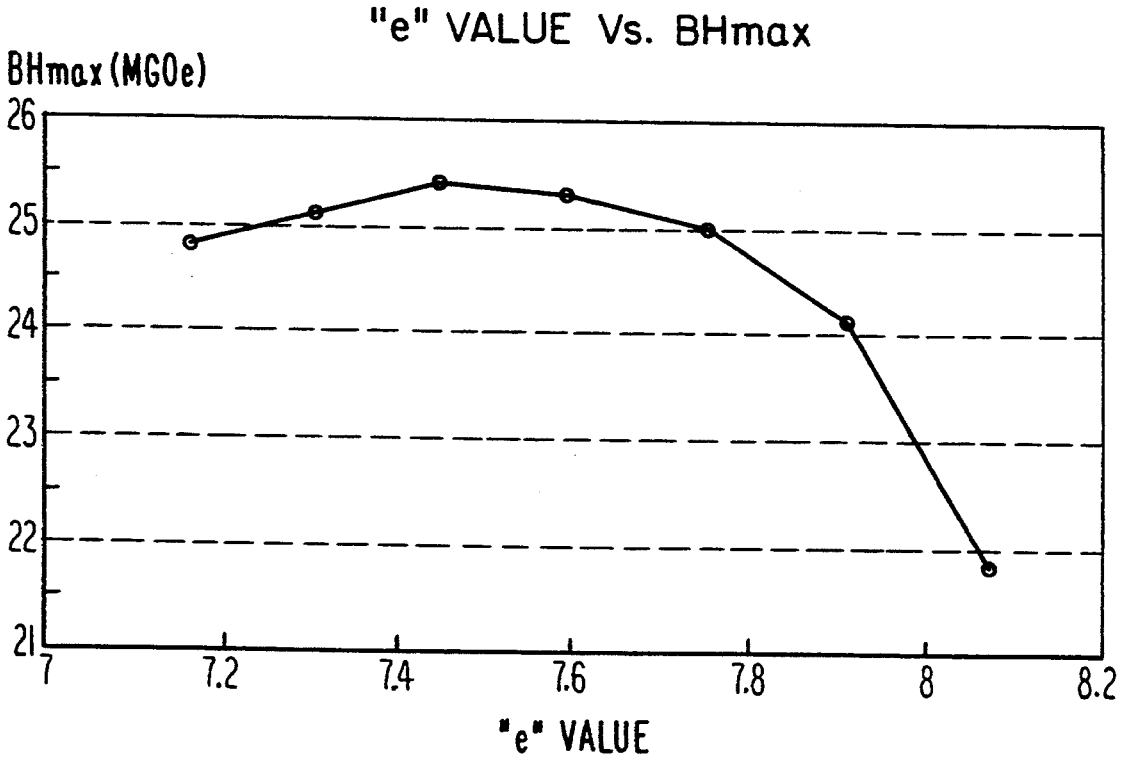

As indicated above, the magnets of the invention have excellent $BH_{max}$ and $H_{ci}$ properties of over 25 MGOe and 25 KOe, respectively. Moreover, these magnets have a superior $H_k$ of over 12 KOe and excellent remanence of over 10 KG. Another important feature of the invention will be best understood by inspecting FIGS. 4A, 4B and 4C. FIGS. 4A, 4B and 4C show the "e" dependence of intrinsic coercivity, squareness, and maximum energy product, respectively, in a series of compositions represented by the formula $[CO_{0.66}\ Fe_{0.25}\ Cu_{0.06}\ Zr_{0.03}]_e$ Sm. As shown by those figures, when e is between about 7.1 and about 7.7, intrinsic coercivity, squareness and maximum energy product are high. Namely, between these "e" values, $H_{ci}$ is above 20 KOe, $H_k$ is at least above about 9 KOe and $BH_{max}$ is above 24 MGOe. Exceptionally high values for all three properties are attained when e equals about 7.2 to about 7.4. Outside these preferred ranges of e, and especially as e approaches 8, these values begin to rapidly decrease. Thus, the magnetic characteristics of the samarium cobalt magnet are highly dependent upon achieving the proper weight percent of each element in the magnet.

The present invention will now be described in the following examples. It is to be understood that this invention is not be considered to be limited by the examples, but solely by the appended claims. All percentages specified are weight percents, based on total weight of the magnets, unless otherwise indicated.

EXAMPLE 1.

Two samarium cobalt alloys were melted and chill-cast to produce homogeneous alloy solids with the following chemical analysis expressed as atomic fractions:

$$[Co_{0.56}Fe_{0.25}Cu_{0.06}Zr_{0.03}]_eSm \qquad \text{EQ. 2}$$

The actual values for the base and adder alloys are given in Table 2.

TABLE 2

| ACTUAL "e" VALUES FOR RAW MATERIALS | |
|---|---|
| BASE ALLOY | ADDER ALLOY |
| 8.07 | 5.54 |

The composition, in weight percent, for the base alloy and adder alloy is shown in Table 3 below:

TABLE 3

| ACTUAL COMPOSITION OF RAW MATERIALS USED | | |
|---|---|---|
| ELEMENT | BASE ALLOY | ADDER ALLOY |
| Cobalt | 49.9% | 45.0% |
| Iron | 17.8% | 16.0% |
| Copper | 5.2% | 4.7% |
| Zirconium | 3.2% | 2.9% |
| Samarium | 23.9% | 31.4% |

Each of the two alloys described in Table 3 were pulverized to pass through a 50 mesh screen. They were then separately attritor milled with n-hexane to produce a slurry of fine powder. Milling time was adjusted to account for different milling characteristics of each alloy so as to produce particle size between 3.8 and 4.6 micron diameter measured by a Fisher sub-sieve size analyzer. The slurry was dried under heat, inert argon atmosphere, and vacuum to remove the hexane and to produce clean dry samarium cobalt powder. The dried powder was then exposed to a controlled amount of air at a temperature between 130° F. and 75° F. to partially oxidize the powders. The purpose of this controlled oxidation was to passivate the powders, thereby making them less reactive to air during subsequent processing steps. After passivation, the two alloy powders were blended in a v-shell blender to various "e" levels shown in Table 4.

Small cylindrical axially-oriented compacts were then produced by die compaction using a pressure of 1.0 metric ton/sq. cm. A magnetic field of 12 KOe was applied in the direction of pressing prior to compaction to align the powder. The green compacts were then sintered under vacuum/argon atmosphere by the cycle set forth in FIG. 1. Sintered parts were then solution heat treated according to FIG. 2.

A final aging treatment was then applied as shown in FIG. 3. The aged magnets resulting from these thermal treatments were then abrasively finished on all surfaces to produce a part for magnetic measurement using an automatic, commercially available hysteresigraph. All samples were pre-magnetized in a pulsed field of 55 KOe prior to placement in the hysteresigraph. The magnetic test results (average of 3 tests for each "e" value) are shown in Table 4 below.

TABLE 4

| MAGNETIC TEST RESULTS | | | | | |
|---|---|---|---|---|---|
| % ADDER | "e" VALUE | Hk | $BH_{max}$ | $H_{ci}$ | $B_r$ |
| 0 | 8.07 | 4.0 | 21.8 | 7.8 | 10.5 |
| 5 | 7.91 | 6.7 | 24.1 | 14.7 | 10.5 |
| 10 | 7.75 | 8.8 | 25.0 | 27.9 | 10.5 |
| 15 | 7.59 | 10.9 | 25.3 | 30.5 | 10.5 |
| 20 | 7.44 | 12.3 | 25.4 | 30.1 | 10.4 |
| 25 | 7.30 | 13.0 | 25.1 | 26.8 | 10.3 |
| 30 | 7.16 | 13.0 | 24.8 | 21.3 | 10.3 |

The data of Table 4 have been analyzed by plotting magnetic parameters of $H_{ci}$, $H_k$ and $BH_{max}$ versus "e" value. These graphs demonstrate the strong influence the composition of the magnet has on the magnetic characteristics.

For example, FIG. 4A shows that intrinsic coercivity increases as "e" increases from about 7.1 to about 7.6, whereupon $H_{ci}$ decreases and then drops rapidly as e approaches 8.

FIG. 4B shows that second quadrant loop squareness is excellent when e ranges from about 7.1 to about 7.4. As e increases above 7.4, $H_k$ decreases.

FIG. 4C demonstrates the effect that the e value has on maximum energy product, with maximum energy products above 24 MGOe having been obtained when e is from about 7.1 to 7.8.

What is claimed is:

1. A permanent magnet, said magnet having an alloy composition consisting essentially of:

from about 25.0 to about 26.3% by weight samarium;
from about 47.9 to about 49.6% by weight cobalt;
from about 17.0 to about 17.7% by weight iron;
from about 4.9 to about 5.2% by weight copper; and
from about 2.7 to about 3.3% by weight zirconium;

said magnet having been prepared by a process comprising the steps of:

a. providing said alloy as a powder compact prepared from at least one melted samarium cobalt metal alloy;
b. sintering said compact;
c. subjecting said sintered compact to solution thermal treatment; and
d. subjecting said sintered compact to aging thermal treatment subsequent to said solution thermal treatment step to provide said magnet having a second quadrant loop squareness of at least about 12 KOe, an intrinsic coercivity of at least about 25 KOe, and a maximum energy product of at least about 22 MGOe.

2. The magnet of claim 1 having:
from about 25.5 to about 26.0% by weight samarium;
from about 48.2 to about 49.2% by weight cobalt;
from about 17.1 to about 17.5% by weight iron;
from about 4.9 to about 5.2% by weight copper; and
from about 2.9 to about 3.3% by weight zirconium.

3. The magnet of claim 1 having:
about 25.8% by weight samarium;
about 48.7% by weight cobalt;
about 17.3% by weight iron;
about 5.1% by weight by copper; and
about 3.1% by weight zirconium.

4. The magnet of claim 1 having a maximum energy product of at least about 24 MGOe.

5. The magnet of claim 4 having a residual induction of at least about 10 KG.

6. The magnet of claim 1 having a maximum energy product of at least about 25 MGOe.

7. The magnet of claim 1 having a residual induction of at least about 10 KG.

8. The magnet of claim 1, wherein said sintering comprises:

a. selecting a sintering temperature of from about 2050 to about 2300 degrees Fahrenheit;
b. presintering said compact at a temperature of from about 5 to about 50 degrees Fahrenheit less than said preselected sintering temperature for from about 10 to about 90 minutes;
c. sintering said compact at said sintering temperature for from about 30 to about 270 minutes; and
d. homogenizing the sintered compact at a temperature lower than the sintering temperature, and between about 2000 and about 2295 degrees Fahrenheit, for from about 20 to about 180 minutes.

9. The magnet of claim 8 wherein said compact has been cooled from the sintering temperature to the homogenizing temperature at a rate of from about 1 to about 5 degrees Fahrenheit per minute.

10. In step (g), third and fourth lines therein, please sustitute—intrinsic coercivity—for "$H_{ci}$", and —maximum energy product—for "$BH_{max}$", respectively.

11. The magnet of claim 10, having:
from about 25.5 to about 26.0% by weight samarium;
from about 48.2 to about 49.2% by weight cobalt;
from about 17.1 to about 17.5% by weight iron;
from about 4.9 to about 5.2% by weight copper; and
from about 2.9 to about 3.3% by weight zirconium.

12. The magnet of claim 10, having:
about 25.8% by weight samarium;
about 48.7% by weight cobalt;
about 17.3% by weight iron;
about 5.1% by weight by copper;
and about 3.1% by weight zirconium.

13. The magnet of claim 10, said magnet having a maximum energy product of at least about 24 MGOe, and a residual induction of at least about 10 KG.

14. A permanent magnet comprising at least one alloy having the formula:

$$(Co_a Fe_b Cu_c Zr_d)_e Sm$$

wherein:
a is from about 0.64 to about 0.68;
b is from about 0.23 to about 0.27;
c is from about 0.060 to about 0.068;
d is from about 0.024 to about 0.029; and
e is from about 7.1 to about 7.7 said magnet having a second quadrant loop squareness of at least about 12 KOe, an intrinsic coercivity of at least about 25 KOe, and a maximum energy product of at least about 22 MGOe.

15. The magnet of claim 14 wherein: e is from about 7.2 to about 7.4.

16. The magnet of claim 14 wherein a is about 0.66, b is about 0.25, c is about 0.064, d is about 0.027, and e is about 7.3.

17. The magnet of claim 14 having a maximum energy product of at least about 24 MGOe.

18. The magnet of claim 14 having a maximum energy product of at least about 25 MGOe.

19. The magnet of claim 18 having a residual induction of at least about 10 KG.

20. A permanent magnet consisting essentially of:
from about 25.0 to about 26.3% by weight samarium;
from about 47.9 to about 49.6% by weight cobalt;
from about 17.0 to about 17.7% by weight iron;
from about 4.9 to about 5.2% by weight copper; and
from about 2.7 to about 3.3% by weight zirconium;
wherein said magnet has a second quadrant loop squareness of at least about 12 KOe, an intrinsic coercivity of at least about 25 KOe, and a maximum energy product of at least about 22 MGOe.

21. The permanent magnet of claim 20 having a maximum energy product of at least about 24 MGOe.

22. The permanent magnet of claim 20 having a maximum energy product of at least about 25 MGOe.

23. The permanent magnet of claim 22 having a residual induction of at least 10 KG.

* * * * *

UNITED STATES PATENT AND TRADEMARK OFFICE

CERTIFICATE OF CORRECTION

PATENT NO. : 5,382,303

DATED : January 17, 1995

INVENTOR(S) : Richard L. Anderson, et al.

It is certified that error appears in the above-indentified patent and that said Letters Patent is hereby corrected as shown below:

Col. 1, line 32, after "range" change "." to --,--.

Signed and Sealed this

Thirty-first Day of October 1995

*Attest:*

Bruce Lehman

BRUCE LEHMAN

*Attesting Officer*

*Commissioner of Patents and Trademarks*